US006981819B1

(12) United States Patent
Suckow et al.

(10) Patent No.: US 6,981,819 B1
(45) Date of Patent: Jan. 3, 2006

(54) TILTING SCREED

(76) Inventors: Robert E. Suckow, 515 First St. North, Maynard, IA (US) 50655; Richard A. Suckow, 1214 Third St. NE., Oelwein, IA (US) 50662

( * ) Notice: Subject to any disclaimer, the term of this patent is extended or adjusted under 35 U.S.C. 154(b) by 0 days.

(21) Appl. No.: 10/757,234

(22) Filed: Jan. 14, 2004

(51) Int. Cl.
*E01C 19/44* (2006.01)

(52) U.S. Cl. ..... 404/114; 404/118

(58) Field of Classification Search ..... 404/114, 404/118

See application file for complete search history.

(56) References Cited

U.S. PATENT DOCUMENTS 4,520,527 A * 6/1985 Maggio et al. ..... 15/235.8
4,838,730 A * 6/1989 Owens ..... 404/114
4,856,932 A * 8/1989 Kraft ..... 404/118
6,089,787 A * 7/2000 Allen et al. ..... 404/118
6,227,750 B1 * 5/2001 Maggio et al. ..... 403/79
6,374,569 B1 4/2002 Suckow

* cited by examiner

*Primary Examiner*—Gary S. Hartmann
(74) *Attorney, Agent, or Firm*—McKee, Voorhees & Sease, P.L.C.

(57) ABSTRACT

A screed plate includes a pair of handles mounted to a pivot member. The pivot member is connected for rotation with respect to a screed plate about a horizontal axis with respect to a screed plate. The vibrator is provided on the screed plate and a tilt actuator is connected to the pivot member and to the screed plate for causing tilting of the screed plate. A laser receiver receives a horizontal laser beam and determines whether or not the receiver is above, below, or at the same level as the laser beam. If the receiver is either above or below the laser beam it sends a signal to the tilt actuator to cause tilting of the screed plate.

3 Claims, 3 Drawing Sheets

TILTING SCREED

BACKGROUND OF THE INVENTION

The present invention relates to a tilting screed and method for using same.

Screeds have been used for leveling and consolidating uncured concrete. These screeds usually include a horizontal member which is moved across the surface of the concrete to level the concrete and prepare it for finishing. Vibrators are sometimes used to cause the screed to vibrate against the surface of the concrete and to consolidate it.

It is desirable to be able to adjust the angle of the screed plate relative to the concrete surface. Sometimes it is desirable to lift the leading edge of the screed plate to allow more concrete under the plate for filling low areas. Other times it is desirable to lift the trailing edge of the screed plate to remove concrete from a high spot.

The prior art has utilized laser receivers for receiving a horizontal laser beam. These laser receivers include a visual indication as to whether or not the screed is resting on a concrete surface that is above or below horizontal. However, these prior art devices have not provided a means for automatically tilting the screed plate in response to the laser sensor determining that either a filling action or a concrete removing action is necessary.

Therefore a primary object of the present invention is the provision of an improved tilting screed and method for using same.

A further object of the present invention is the provision of an improved tilting screed and method for using same which automatically tilts the screed in response to sensing whether the concrete surface is lower or higher than desired.

A further object of the present invention is the provision of an improved tilting screed and method for using same which utilizes a pivotal member attached to both of the first and second handles.

A further object of the present invention is the provision of a tilting screed and method for using same which utilizes a tilting member having two handles attached thereto and having a tilt actuator also attached thereto.

A further object of the present invention is the provision of a tilting screed and method for using same which senses a laser beam and which automatically actuates a tilt actuator for tilting the screed whenever the concrete is either above or below a predetermined level.

A further object of the present invention is the provision of a tilting screed and method for using same which is economical to manufacture, durable in use and efficient in operation.

BRIEF SUMMARY OF THE INVENTION

The foregoing objects may be achieved with a concrete screed for smoothing an uncured concrete surface. The screed includes a screed blade having first and second opposite ends, a leading edge, a trailing edge, and a flat bottom surface. The screed blade is elongated and has a longitudinal screed blade axis. The bottom surface is adapted to rest on the uncured concrete surface. A vibrator is mounted on the screed blade and is capable of actuation to cause vibration of the screed plate. A pivot member is pivotally mounted to the screed plate for pivotal movement about a horizontal pivot axis extending in the same general direction of the longitudinal screed plate axis.

A first handle and a second handle each have an attachment end mounted to the pivot member. The first and second handles also each have a gripping end opposite from the attachment end for gripping the handles. A tilt actuator is connected to both the pivot member and the screed plate. The tilt actuator is capable of actuation to cause the pivot member and the screed to rotate relative to one another about the horizontal pivot axis.

According to another feature of the present invention the first and second handles prevent rotation of the pivot member about the horizontal pivot axis when the gripping ends of the first and second handles are held at a constant height above the concrete surface. The tilt actuator causes the screed plate to pivot about the horizontal pivot axis relative to the pivot member during actuation of the tilt actuator.

According to another feature of the present invention a laser receiver is attached to the screed plate and is electrically connected to the tilt actuator for actuating the tilt actuator. The laser receiver is capable of sensing the height surface relative to a fixed horizontal height. The height detector actuates the tilt actuator in response to sensing when the concrete surface is either above or below a predetermined distance from the fixed horizontal height.

According to another feature of the present invention a laser beam extends horizontally at a fixed height. The height detector is capable of receiving the laser beam and calculating the distance of the laser beam from the concrete surface.

According to another feature of the present invention the tilt actuator comprises first and second actuator members that are longitudinally extensible with respect to one another when the tilt actuator is actuated.

According to another feature of the present invention the first and second handles are pivotally mounted to the pivot member for pivotal movement about first and second axis that are perpendicular to the horizontal pivot axis of the pivot member.

The foregoing objects may be achieved by a method comprising taking a screed plate having a bottom surface resting on the concrete surface, a pivot member pivotally mounted to the screed plate for pivotal movement about a horizontal pivot axis, and a pair of handles each having an attachment end attached to the pivot member and a gripping end for gripping by an operator. The method comprises sensing the distance of the screed plate resting on the concrete from a fixed horizontal height and tilting the screed plate about the horizontal pivot axis in response to the sensed distance of the screed plate from the fixed horizontal height being either above or below a predetermined distance.

A further feature of the method present invention comprises tilting the screed plate in a first direction about the horizontal axes in response to the sensed distance being above the predetermined distance and tilting the screed plate in a second direction opposite from the first direction about the horizontal pivot axes in response to the sensed distance being below the predetermined distance.

According to another feature of the method of the present invention the gripping ends of the first and second handles are held at a constant height during operation above the surface of the concrete during the sensing and tilting steps. This holds the pivot member against pivotal movement about the horizontal pivot axis during the sensing and tilting steps.

According to another feature of the method present invention the first and second handles are pivotally mounted to the pivot member for pivotal movement about first and second axes perpendicular to the horizontal pivot axis of the pivot member. The method comprises pivoting the first and second handles about the first and second axes while holding the pivot member against pivotal movement about the horizontal pivot axis.

DETAILED DESCRIPTION OF THE PREFERRED EMBODIMENT

Figure 1:
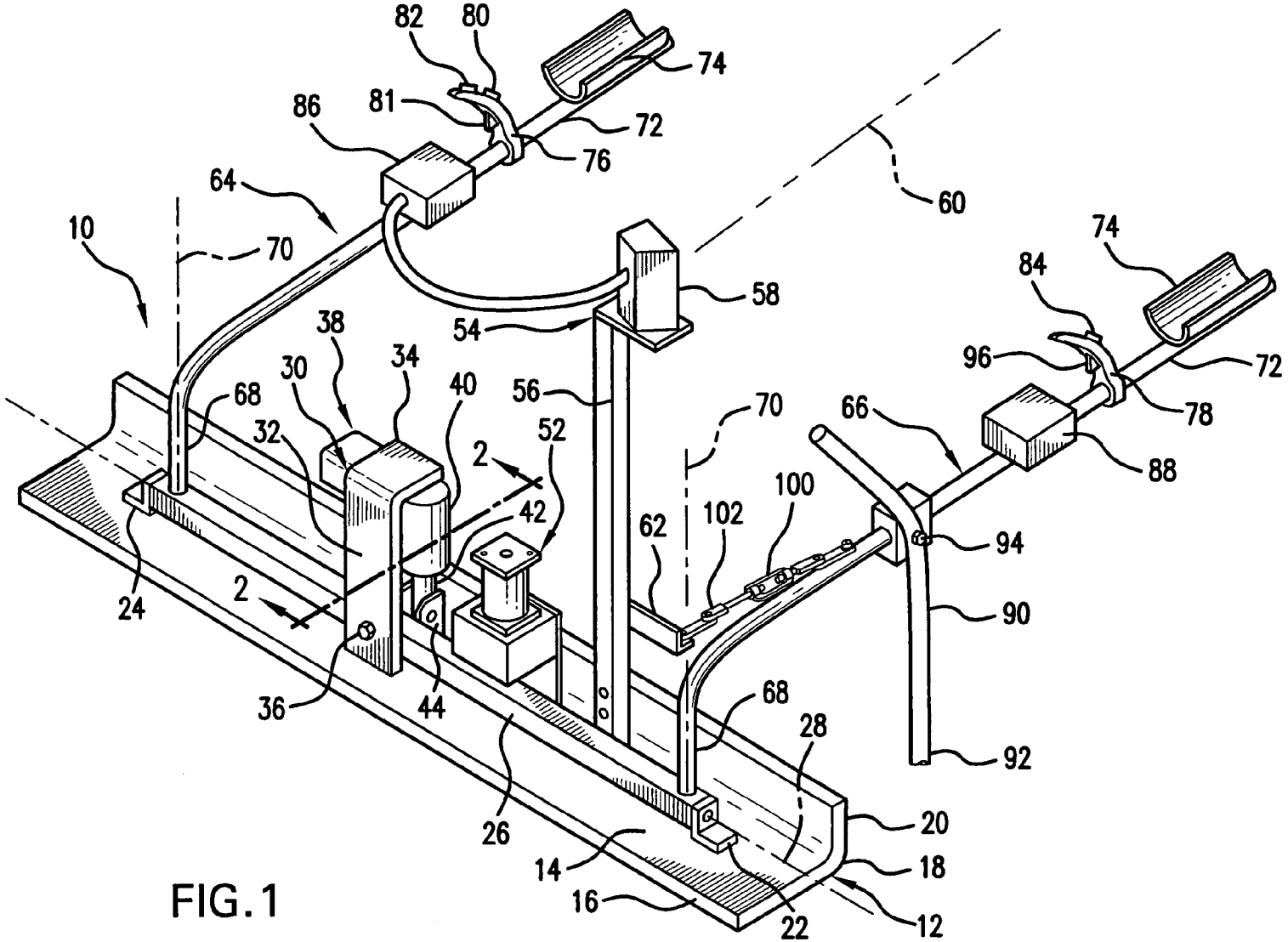
FIG. 1 is perspective view of the tilting screed of the present invention.

Referring to FIG. 1 a screed 10 includes a screed blade or plate 12 having a screed base 14 with a forward edge 16 and a rear edge 18. A screed flange 20 extends vertically up from the rear edge 18 so that the screed blade or plate 12 is of an L-shaped configuration. The bottom surface of the screed base 14 is adapted to rest on an uncured concrete surface.

A pair of pivot ears 22, 24 are attached to the upper surface of the screed base 14 or to screed flange 20 by welding, bolting or other securing means. The pivot ears 22, 24 are L-Shaped in configuration and include a pivot member or bar 26 pivotally mounted therebetween for pivotal movement about a horizontal pivot axis designated by the numeral 28.

Figure 2B:
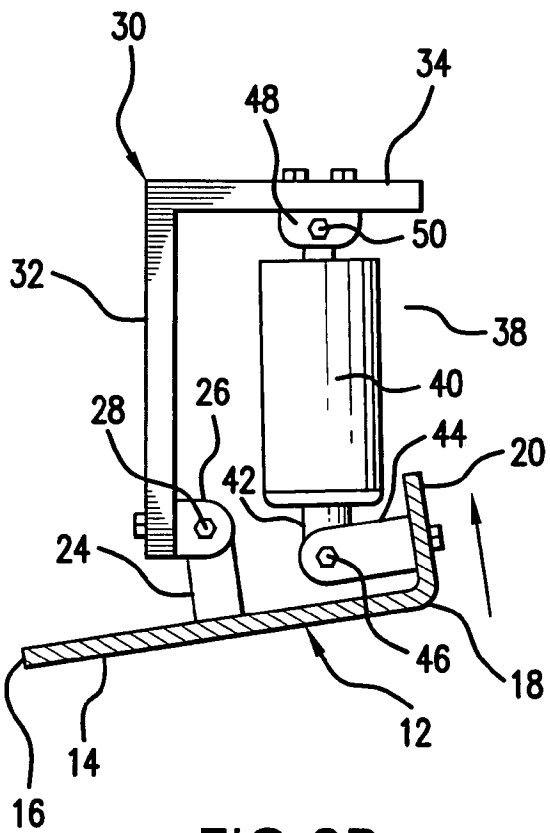
FIG. 2B is a view similar to FIG. 2, but showing the screed plate tilted in the opposite direction.
Figure 2A:
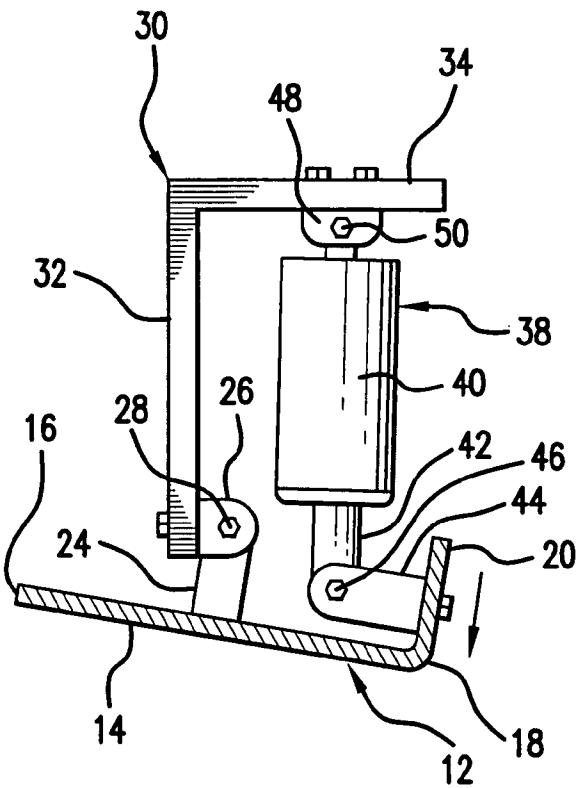
FIG. 2A is view similar to FIG. 2, but showing the screed plate tilted in a first direction.
Figure 2:
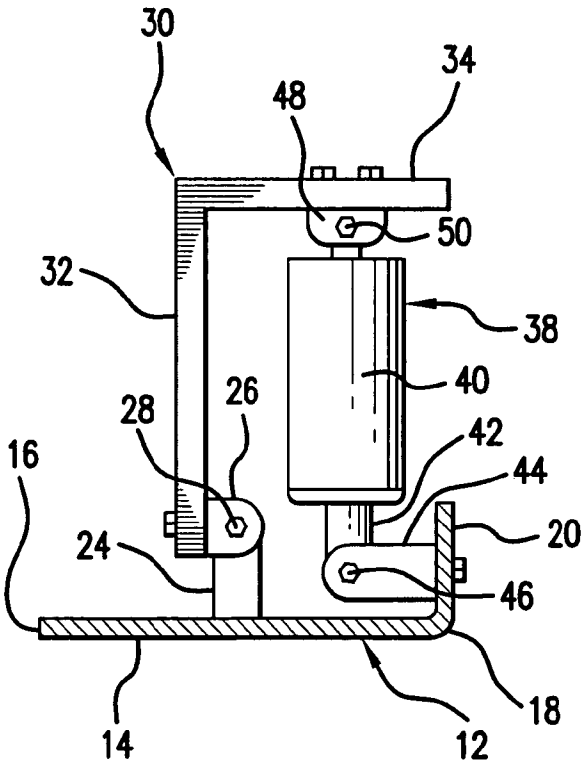
FIG. 2 is a sectional view taken along line 2—2 of FIG. 1.

Attached to the pivot member or bar 26 by a bolt 36 and extending upwardly therefrom is a mounting bracket 30 comprising an upstanding frame member 32 and a horizontal frame member 34. Mounted to the horizontal frame member 34 is an actuator 38 which is pivotally attached at its upper end to actuator ears 48 for pivotal movement about the actuator axis 50. The actuator 38 includes a cylinder 40 and a cylinder rod 42 which are longitudinally extensible with respect to one another. Preferably these are electronically actuated for extensible movement. An example of a preferred actuator 38 is manufactured by Danaher Motion under the part Number DE12-17W41-04-FPHHN. It is a 12–24 volt deactuator. The lower end of cylinder rod 42 is pivotally attached to rod receiving ears 44 for pivotal movement about the rod pivot 46. As can be seen in FIGS. 2, 2A and 2B, the horizontal pivot axis 28 of the pivot member or bar 26 is spaced from the rod pivot point 46 so that extension and retraction of the cylinder 40 and the cylinder rod 42 causes the screed plate 12 to pivot from its neutral position shown in FIG. 2 to either its first tilt position shown in FIG. 2A wherein the rod 42 is extended or to its second tilt position shown in FIG. 2B wherein the rod 42 is in a retracted position.

Also mounted on the screed plate 12 is a vibrator mechanism 52 which is typical of other vibrating mechanisms utilized with screed plates. Extending upwardly from the screed plate 12 is a laser receiver assembly 54 comprising an upstanding support 56 and a laser receiver 58 mounted at the upper end thereof. The laser receiver 58 is adapted to receive a laser beam 60 emanating at a fixed horizontal level which provides a reference point for whether or not the screed plate 12 is above or below a predetermined distance from laser beam 60. If the receiver 58 is above the horizontal laser beam 60 then the screed plate 12 is resting on a concrete surface that is above the desired level. If the receiver 58 is at the same level as horizontal laser beam 60, then the screed plate 12 is resting on a concrete surface at the desired level. If the receiver 58 is below the horizontal laser beam 60, then the screed plate 12 is in a dip or depression in the concrete surface and filling is desired.

The upstanding member 56 is attached at its lower end to the screed flange 20. A leveling angle member 62 extends horizontally from the upstanding member 56.

A first handle 64 and second handle 66 are both pivotally mounted at their lower ends 68 to the pivot member or bar 26 so that they rotate about the horizontal pivot axis 28 in unison with the pivot member or bar 26. However, the handles 64, 66 are pivotally mounted to the pivot member or bar 26 for pivotal movement about axes 70 which are perpendicular to the horizontal pivot axis 28. The first and second handles 64, 66 each include an upper handle end 72. When the upper handle end 72 is held at a constant height, the pivot bar 26 is held against rotation about horizontal pivot axis 28. However, extension or retraction of the rod 42 in the tilt actuator 38 will cause the tilting of the screed plate 12 to the various orientations shown in FIGS. 2, 2A and 2B.

Attached to the upper ends 72 of the handles 66, 68 are a pair of arms rests 74. On the right handle 64, is a right control 76 and on the second handle 66 is a left control handle 78. The right control 76 includes a button switch 80, a rocker switch 82, and a trigger switch 81 thereon. The right control 76 also includes a trigger switch 96 and a potentiometer 84.

Figure 3:
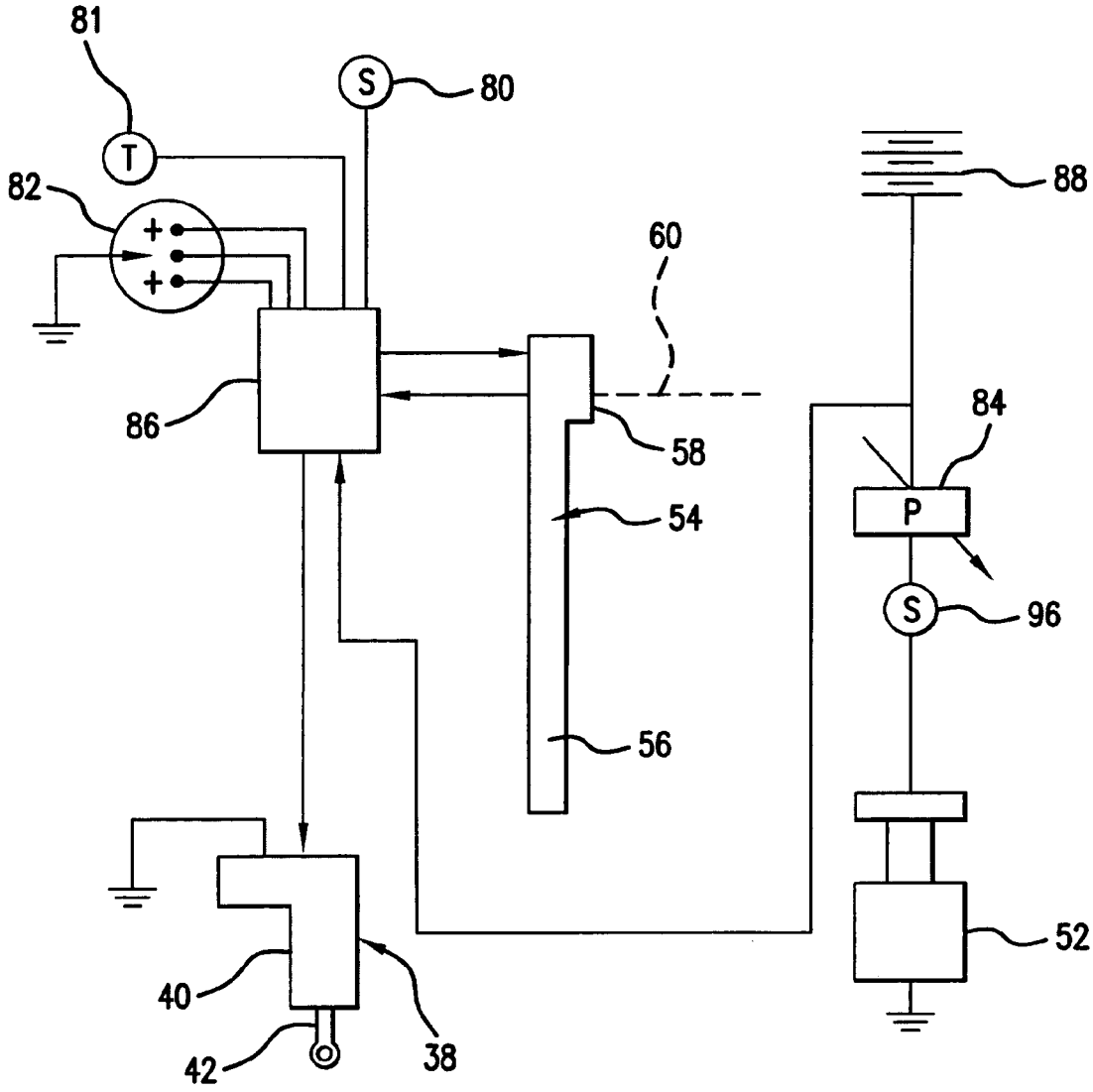
FIG. 3 is a schematic view showing the electrical interconnection of the parts.

FIG. 3 is a schematic drawing showing the interconnection of the various parts. A rechargeable battery 88 is mounted on the left handle 66 and is electrically connected to switch 96, potentiometer 84 and vibrator 52. Potentiometer 84 is rotatably adjustable to change the intensity of the vibrations caused by vibrator mechanism 52. If the slump of the concrete is drier or lower the potentiometer 84 is turned to cause the vibrator to vibrate with more intensity and higher frequency. If the slump of the concrete is wetter or higher than the potentiometer 84 is set so as to reduce the frequency and intensity of the vibrator 52. Switch 96 turns the vibrator 52 on or off and the vibrator 52 will not operate unless switch 96 is on.

Battery 88 is also connected to tilt control box 86. Trigger switch 81 actuates the control box 86 and switch 80 acts through control box 86 to actuate or deactuate receiver 58. Rocker switch 82 is a three position override switch. In its neutral position shown in FIG. 3 it does not override actuator 38 and lets the control box 86 automatically control the actuation of actuator 38. In this automatic mode receiver 58 sends a signal to control box 86 whether the receiver 58 is above, below, or even with the horizontal laser beam 60. If the receiver 58 is below the laser beam 50 it sends a signal to control box 86 to actuate tilt actuator 38 to cause the screed plate or blade 12 to move to the position of FIG. 2. Conversely, if the receiver is above the laser beam 60 it sends a signal to control box 86 to cause actuator 38 to move to the position of FIG. 2B. Rocker switch 82 can be used to override to automatic control provided by control box 86 and cause the screed plate or blade 12 to move to the positions shown in FIGS. 2A and 2B as the operator chooses. Unless trigger switch 81 is in its on position the control box and the actuator 38 cannot be actuated.

Rechargeable battery 88 drives the vibrator 52, the receiver 58, the control box 86 and the tilt actuator 38.

Referring again to FIG. 1, a support leg 90 is pivotally mounted about a leg pivot 94 and includes a lower end 92 which rests on the surface supporting the screed plate 12.

During the operation of the device with an operator grasping the handles 64, 66, the support leg 90 is pivoted to a position approximately parallel to the handle 66 so that it is out of the way.

A turn buckle 100 is connected at one end to the handle 66 and is connected at the other end to a turn buckle link 102 which in turn is connected to leveling angle 62. The turn buckle 100 may be turned to cause the upstanding member 56 to be substantially vertical in accommodation to the particular height of the operator operating the screed device 10. For taller operators the turn buckle can be adjusted to accommodate the handle ends 72 being at a higher level and for a shorter operator the turn buckle 100 can be correspondingly changed to accommodate the shorter operator. Once the turn buckle 100 is adjusted for a particular operator the upstanding member 56 will be substantially vertical.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. A concrete screed adapted to react automatically relative to a horizontal laser beam of fixed height above an uncured concrete surface, the screed comprising:

a screed plate having first and second opposite ends, a leading edge, a trailing edge, and a flat bottom surface, the screed plate being elongated and having a longitudinal screed plate axis, the bottom surface of the screed plate resting on the uncured concrete surface;

a vibrator mounted on the screed plate and being capable of actuation to cause vibration of the screed plate;

a pivot member pivotally mounted to the screed plate for pivotal movement about a horizontal pivot axis extending in the same general direction of the longitudinal screed plate axis;

a first handle and a second handle each having a first handle end connected to the pivot member, for pivotal movement about first and second axes, respectively, that are perpendicular to the horizontal pivot axis of the pivot member, the first and second handles each having a gripping end opposite from the first handle ends for gripping the handles;

the first and second handles being attached to the pivot member in such a way that when the gripping ends of either or the first and second handles are held at a constant height they hold the pivot member against tilting movement about the horizontal pivot axis and the screed plate can tilt relative to the pivot member about the horizontal pivot axis;

a laser beam detector on the screed plate for detecting whether or not the laser beam detector is above or below the horizontal laser beam;

a tilt actuator electrically connected to the laser beam detector and being mechanically connected to both the screed plate and the pivot member;

the tilt actuator causing the screed plate to tilt about the horizontal axis in a first direction in response to the laser beam detector sensing that the laser beam detector is below the horizontal laser beam and tilting the screed plate about the horizontal axis in a second direction opposite from the first direction in response to the laser beam detector sensing that the laser beam detector is above the horizontal laser beam.

2. The concrete screed according to claim 1 wherein the tilt actuator comprises first and second actuator members that are longitudinally extensible with respect to one another when the tilt actuator is actuated.

3. A concrete screed for smoothing an uncured concrete surface and for reacting to a horizontal laser beam of fixed horizontal height above the concrete surface, comprising:

a screed plate having first and second opposite ends, a leading edge, a trailing edge, and a flat bottom surface, the screed plate being elongated and having a longitudinal screed plate axis, the bottom surface being adapted to rest on the uncured concrete surface;

a vibrator mounted on the screed plate and being capable of actuation to cause vibration of the screed plate;

a pivot member pivotally mounted to the screed plate for pivotal movement about a horizontal pivot axis extending in the same general direction of the longitudinal screed plate axis;

a first handle and a second handle each having an attachment end pivotally mounted to the pivot member about first and second pivot axes, respectively, that are perpendicular to the horizontal pivot axis of the pivot member, the first and second handles each having a gripping end opposite from the attachment end for gripping the handles;

a tilt actuator connected to both the pivot member and the screed plate, the tilt actuator being capable of actuation to cause the pivot member and the screed plate to rotate relative to one another about the horizontal pivot axis;

a laser beam detector attached to the screed plate for sensing the laser beam and being electrically connected to the tilt actuator for actuating the tilt actuator, the laser beam detector being capable of sensing the height of the concrete surface relative to the fixed horizontal height of the laser beam, the laser beam detector actuating the tilt actuator in response to sensing when the concrete surface is either above or below a predetermined distance from the fixed horizontal height.

* * * * *